United States Patent [19]

Glass, Jr.

[11] 4,272,565

[45] Jun. 9, 1981

[54] FINISH APPLICATION FOR TANDEM WINDING

[75] Inventor: James P. Glass, Jr., Pensacola, Fla.

[73] Assignee: Monsanto Company, St. Louis, Mo.

[21] Appl. No.: 96,953

[22] Filed: Nov. 23, 1979

[51] Int. Cl.[3] ..... B65H 54/04

[52] U.S. Cl. ..... 427/177; 118/204; 118/234; 264/210.3

[58] Field of Search ..... 118/204, 234; 427/175, 427/177; 65/3 R, 3 C; 264/210.3

[56] References Cited

U.S. PATENT DOCUMENTS

| | | | |
|---|---|---|---|
| 2,647,697 | 8/1953 | Pollock, Jr. | 242/35.5 R |
| 3,037,451 | 6/1962 | Davis | 101/350 |
| 3,104,182 | 9/1963 | Schneider et al. | 118/204 |
| 3,186,377 | 6/1965 | Schuessler | 118/204 X |
| 3,421,926 | 1/1969 | Davies et al. | 427/177 |

*Primary Examiner*—Evan K. Lawrence

*Attorney, Agent, or Firm*—Kelly O. Corley

[57] ABSTRACT

A finish skirt redistributes finish along the surface of the finish roll, providing extra finish to the yarn wound on the second bobbin in tandem winding, compensating for finish blotted off on the bobbin collecting the first yarn.

4 Claims, 2 Drawing Figures

FINISH APPLICATION FOR TANDEM WINDING

The invention relates to the art of finish application to yarns being tandem-wound, and more particularly to the reduction of difference in finish level on such yarns after they are on their respective bobbins.

Tandem winding of yarns is disclosed in U.S. Pat. No. 2,647,697, and the problem of unequal finish concentrations on the yarns on the tandem bobbins is disclosed in U.S. Pat. No. 3,421,926 to Davies. The disclosures of these patents are incorporated herein by reference. Davies discloses that the problem can be solved by appropriately restricting the effective lateral width of the finish roll portion contacted by each yarn. However, the Davies approach lacks somewhat in flexibility and is relatively expensive, since the finish roll structure frequently would require changing in order to accommodate tandem winding of different yarns counts, or different winding conditions.

According to the present invention, there is provided a new process for performing the functions disclosed by Davies, permitting in many cases an increased flexibility when changing winding conditions and reduced capital costs.

According to a first major aspect of the invention, there is provided in a process for applying finish to first and second yarns being wound on respective first and second bobbins, the first and second bobbins forming respective first and second nips with and being driven by frictional engagement with a shared bobbin drive roll, the yarns having finish applied thereto by contact with respective first and second different regions on the periphery of a rotating finish roll prior to entering the nips, the first yarn passing through the first nip and being wound on the first bobbin, the second yarn passing through the first and second nips and being wound on the second bobbin, the improvement comprising providing a thicker finish film on the second region of the finish roll than on the first region of the finish roll.

According to another aspect, substantially the same thickness of finish film is supplied across the periphery of the finish roll, and a portion of the film is redistributed to the second region prior to contact of the finish roll and the second yarn.

According to another aspect, a finish skirt contacts the finish roll prior to contact of the finish roll with the yarns, the finish skirt being selected to distribute a thicker finish film to the second region than to the first region.

According to another aspect, the finish skirt has a trailing edge extending diagonally across the finish roll.

Figure 1:
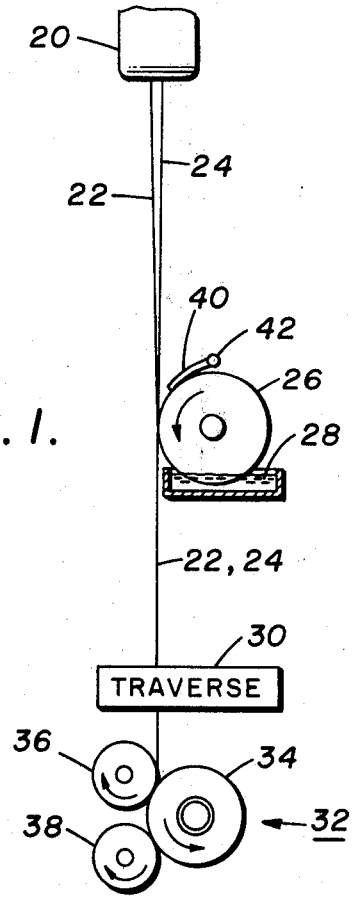
Figure 2:
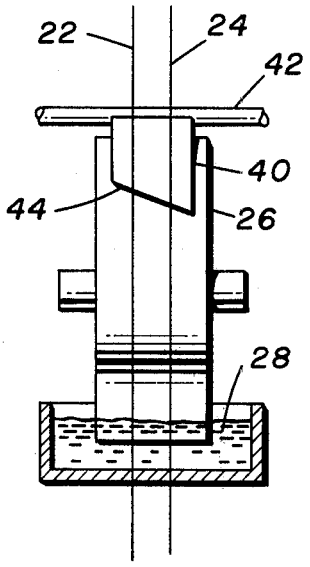

Other aspects will in part be disclosed below and will in part be obvious from the following detailed description taken in connection with the accompanying drawing, wherein:

FIG. 1 is a schematic side elevation view of a melt spinning process, showing finish application according to the invention in combination with tandem winding; and FIG. 2 is a partial front perspective view, looking slightly downwardly, of the preferred embodiment of finish application according to the invention.

As shown in FIGS. 1 and 2, molten polymer is spun from spinneret 20 and conventionally quenched to form yarns 22 and 24. Spin finish is applied to each yarn by slowly rotating finish roll 26 having its lower surface immersed in liquid finish 28. The periphery of roll 26 is thus continuously provided with a film of liquid finish. As yarns 22 and 24 tangentially contact separate regions on the periphery of finish roll 26, finish is transferred from the film on roll 26 to the yarns.

Yarns 22 and 24 next pass through a traverse mechanism 30 prior to entering tandem windup assembly 32. Assembly 32 comprises bobbin drive roll 34 frictionally engaging and driving first and second bobbins 36 and 38, respectively. First yarn 22 passes through the first nip, formed between bobbin 36 and bobbin drive roll 34, and is wound on bobbin 36. Second yarn 24 passes through the first nip and then through the second nip, formed between bobbin 38 and bobbin drive roll 34, and is wound on bobbin 38. In such a tandem winding system, some of the finish applied to the second yarn 24 is blotted off by and transferred to yarn 22 previously wound on first bobbin 36.

This transfer of finish from the second to the first yarn is compensated for by supplying an appropriate initial excess amount of finish to the second yarn so that the yarns as finally wound on the respective bobbins have substantially the same finish level. According to the present invention, this is accomplished by providing a thicker finish film on the second region of finish roll 26 (i.e., the region contacted by second yarn 24) than on the first region of finish roll 26 (the region contacted by first yarn 22).

This is most readily done by supplying substantially the same thickness of finish film across the periphery of finish roll 26, and then redistributing a portion of the film to the second region of roll 26 prior to contact of finish roll 26 and yarn 24. The presently preferred method of redistributing the finish is by use of finish skirt 40 supported by rod 42. Skirt 40 has its trailing edge 44 constructed to extend diagonally downward across the periphery of finish roll 26 from the first region to the second region where the peripheral velocity of the roll is downwards. Selection of finish skirt material, dimensions, and the contour of the trailing edge will vary somewhat depending on the yarn denier and number of filaments, winding speed, finish viscosity, finish roll speed, and diameter, desired finish levels on the yarns, and other such parameters as will be apparent to those skilled in the art, and may be arrived at with minimal experimentation for a given winding process.

What is claimed is:

1. In a process for applying finish to first and second yarns being wound on respective first and second bobbins, said first and second bobbins forming respective first and second nips with and being driven by frictional engagement with a shared bobbin drive roll, said yarns having finish applied thereto by contact with respective first and second different regions on the periphery of a rotating finish roll prior to entering said nips, said first yarn passing through said first nip and being wound on said first bobbin, said second yarn passing through said first and second nips and being wound on said second bobbin, the improvement comprising providing a thicker finish film on said second region of said finish roll than on said first region of said finish roll.

2. The process defined in claim 1, wherein said step of providing comprises supplying substantially the same thickness of finish film across the periphery of said finish roll, and redistributing a portion of said film to said second region prior to contact of said finish roll and said second yarn.

3. The process defined in claim 1, wherein said step of providing comprises contacting the periphery of said finish roll with a finish skirt prior to contact of said finish roll with yarns, said finish skirt being selected to distribute a thicker finish film to said second region than to said first region.

4. The process defined in claim 3, wherein said finish skirt has a trailing edge contacting the periphery of said finish roll in a region where the peripheral velocity of the roll is downwards, said trailing edge extending diagonally downward across said roll periphery from said first region to said second region.

* * * * *

UNITED STATES PATENT AND TRADEMARK OFFICE

CERTIFICATE OF CORRECTION

PATENT NO. : 4,272,565

DATED : June 9, 1981

INVENTOR(S) : James P. Glass, Jr.

It is certified that error appears in the above-identified patent and that said Letters Patent are hereby corrected as shown below:

Column 3, line 2, after "with" insert --said--.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*